United States Patent [19]

Taketani

[11] Patent Number: 5,024,544

[45] Date of Patent: Jun. 18, 1991

[54] METHOD AND SYSTEM FOR CONTROLLING MECHANISM SECTIONS OF PRINTING APPARATUS

[75] Inventor: Mitsuhiro Taketani, Tokyo, Japan

[73] Assignee: Kabushiki Kaisha Toshiba, Kawasaki, Japan

[21] Appl. No.: 449,151

[22] Filed: Dec. 15, 1989

Related U.S. Application Data

[63] Continuation of Ser. No. 212,377, Jun. 27, 1988, abandoned.

[30] Foreign Application Priority Data

Jun. 30, 1987 [JP] Japan ..... 62-163057

[51] Int. Cl.[5] ..... B41J 29/02

[52] U.S. Cl. ..... 400/692; 400/175; 400/322; 400/568

[58] Field of Search ..... 400/61, 144, 175, 322, 400/568, 692

[56] References Cited

U.S. PATENT DOCUMENTS 4,051,945 10/1977 Fujimoto ..... 197/176
4,281,938 8/1981 Phillips ..... 400/144.2
4,323,315 4/1982 Demonte ..... 400/144.2
4,497,589 2/1985 Figini ..... 400/61
4,502,130 2/1985 Kuckuk ..... 365/52
4,553,866 11/1985 Demonte ..... 400/144.2
4,728,964 3/1988 Sasaki ..... 400/76
4,747,709 5/1988 Ueda ..... 400/144.2

*Primary Examiner*—David A. Wiecking
*Assistant Examiner*—Steven S. Kelley
*Attorney, Agent, or Firm*—Finnegan, Henderson, Farabow, Garrett, and Dunner

[57] ABSTRACT

Control parameters necessary for controlling mechanism sections of a printing apparatus are stored in a program ROM. Selection data used for selecting predetermined control parameters stored in the program ROM are stored in a non-volatile memory. When operations of the mechanism sections of the printing apparatus are selectively changed, the selection data stored in the non-volatile memory are changed in accordance with operating states of the mechanism sections. The mechanism sections of the printing apparatus can be controlled upon every change in their operations without replacement of the ROM for storing the control parameters.

15 Claims, 5 Drawing Sheets

METHOD AND SYSTEM FOR CONTROLLING MECHANISM SECTIONS OF PRINTING APPARATUS

This application is a continuation of application Ser. No. 07/212,377, filed June 27, 1988 abandoned.

BACKGROUND OF THE INVENTION

1. Field of the Invention

The present invention relates to a method and system for controlling mechanism sections of a printing apparatus.

2. Description of the Related Art

Mechanism sections such as a print head, a paper feed mechanism, and a carriage drive mechanism in a conventional printing apparatus are controlled according to a control program executed by a CPU (Central Processing Unit) built into the printing apparatus. This control program is normally stored in a ROM (Read-Only Memory) in the printing apparatus. When control parameters necessary to control the mechanism sections are changed, even if the number of control parameters to be changed is small, the entire control program must be changed. Therefore, a currently used ROM must be replaced with another one.

The ROM stores a control program including mechanism section control parameters such as excitation time of the print head, a paper motion amount of the printing sheet in automatic paper feeding (i.e., an aligning amount of printing sheet at the start of printing), and acceleration/deceleration data of a carriage motor. These control parameters are predetermined by the characteristics of the mechanism sections, the excitation characteristics of the print head, a position of a paper end switch for determining an auto load amount of the printing sheet in automatic paper feeding, the characteristics of the carriage motor, and printing timings, and the like. For example, when a control parameter of 100 μs as the excitation time of the print head is changed to 200 μs by exchange of the print head, a control program must be entirely changed because the conventional printing apparatus is fixed the control parameters. Therefore, a plurality of ROMs (i.e., a plurality of control programs) must be prepared as maintenance components for the mechanism sections when the control parameters are changed.

It is desireable to control the mechanism sections without replacing the ROM for storing the control parameters even if the states of the mechanism sections in the printing apparatus are changed.

SUMMARY OF THE INVENTION

It is an object of the present invention to provide a method and system for controlling mechanism sections of a printing apparatus.

According to one aspect of the present invention, there is provided a method of controlling mechanism sections of a printing apparatus, the method comprising the steps of: storing a plurality of control parameters necessary for controlling the mechanism sections of the printing apparatus; non-volatilely-storing selection data used for selecting predetermined control parameters of the plurality of stored control parameters; and reading out the control parameters selected by the selection data and controlling the mechanism sections of the printing apparatus in accordance with the readout control parameters.

According to another aspect of the present invention, there is provided a system for controlling mechanism sections of a printing apparatus, the system comprising: control parameter memory means for storing a plurality of control parameters necessary for controlling the mechanism sections of the printing apparatus; non-volatile memory means for non-volatilely-storing selection data used for selecting predetermined control parameter of the plurality of control parameters stored in the control parameter memory means; mechanism section control means for reading out the control parameters from the control parameter memory means in accordance with the selection data stored in the non-volatile memory means and controlling the mechanism sections of the printing apparatus in accordance with the readout control parameters; and changing means for changing the selection data stored in the non-volatile memory means.

According to one another aspect of the present invention, there is provided a system for controlling mechanism sections of a printing apparatus, the system comprising: control parameter memory means for storing a plurality of control parameters necessary for controlling the mechanism sections of the printing apparatus; non-volatile memory means for non-volatilely-storing selection data used for selecting predetermined control parameter of the plurality of control parameters stored in the control parameter memory means; and mechanism section control means for reading the out control parameters from the control parameter memory means in accordance with the selection data stored in the non-volatile memory means and controlling the mechanism sections of the printing apparatus in accordance with the readout control parameters.

DETAILED DESCRIPTION OF THE PREFERRED EMBODIMENT

An embodiment of the present invention will be described with reference to the accompanying drawings.

Figure 1:
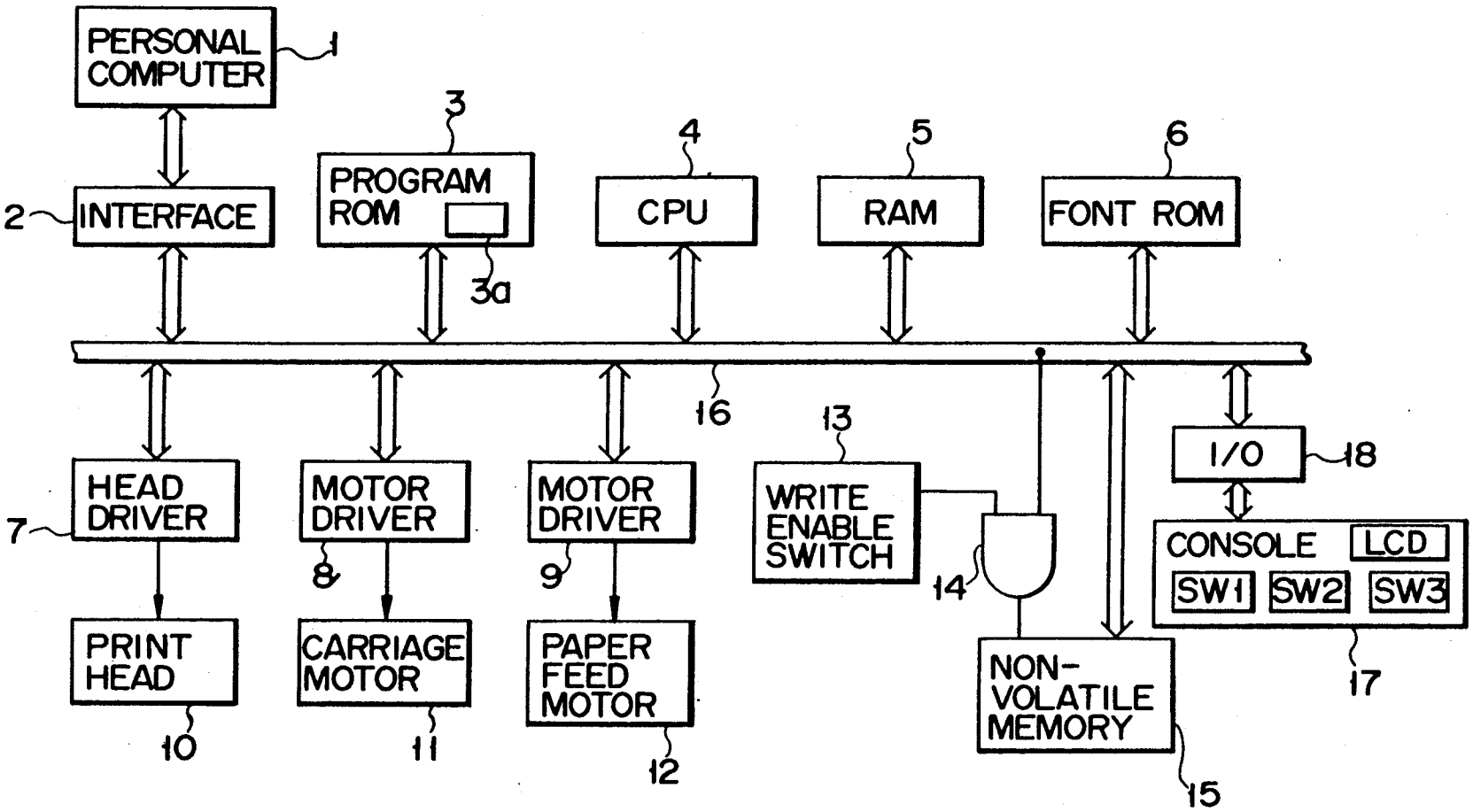
FIG. 1 is a block diagram showing an arrangement of a wire dot impact serial printer according to an embodiment of the present invention.

Referring to FIG. 1, printing data transferred from personal computer 1 is stored in RAM 5 through interface 2 and system bus 16. The printing data stored in RAM 5 is converted into a character pattern by using a font pattern stored in font ROM 6. CPU 4 controls mechanism sections such as print head 10, carriage motor 11, paper feed motor 12, and the like through system bus 16, head driver 7, and motor drivers 8 and 9, and instructs to perform printing on a printing sheet in accordance with the converted character pattern.

Figure 2:
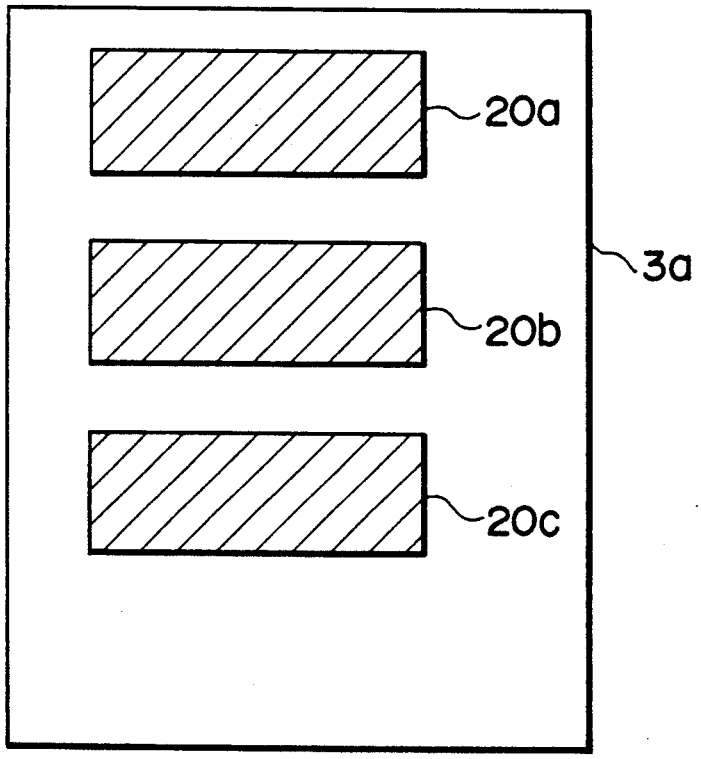
FIG. 2 is a table of mechanism section control parameters stored in a program ROM in FIG. 1.

Program ROM 3 prestores a program for controlling the mechanism sections, and table 3*a* including a plurality of control parameters in units of mechanism sections. As shown in FIG. 2, table 3*a* includes control parameters 20*a* such as 100 μs, 200 μs, and 250 μs for an excitation time of the print head, control parameter 20*b* for an auto load amount, and control parameter 20c for acceleration/deceleration data of the carriage motor.

Selection data are stored in non-volatile memory 15 in units of mechanism sections to select predetermined control parameters in accordance with the states of the mechanical sections at shipping of the printing apparatus. Non-volatile memory 15 receives a write signal output from CPU 4 through AND gate 14, and read, chip selection, and write enable signals output from CPU 4. Write enable switch 13 is connected to AND gate 14. A write signal output from CPU 4 is supplied to non-volatile memory 15 in accordance with the state of write enable switch 13. By the above operations, the selection data stored in non-volatile memory 15 is read out and is written in non-volatile memory 15.

A manufacturer or an adjuster operate write enable switch 13 to change the content of non-volatile memory 15 in accordance with the states of the mechanism sections. Switch 13 is arranged inside the printing apparatus to prevent a user from operating switch 13.

Console 17 is connected to system bus 16 through I/0 (input/output) port 18. Console 17 includes LCD (Liquid Crystal Display) as display device.

An operation of the printing apparatus of this embodiment will be described with reference to a flow chart in FIG. 3.

Figure 3:
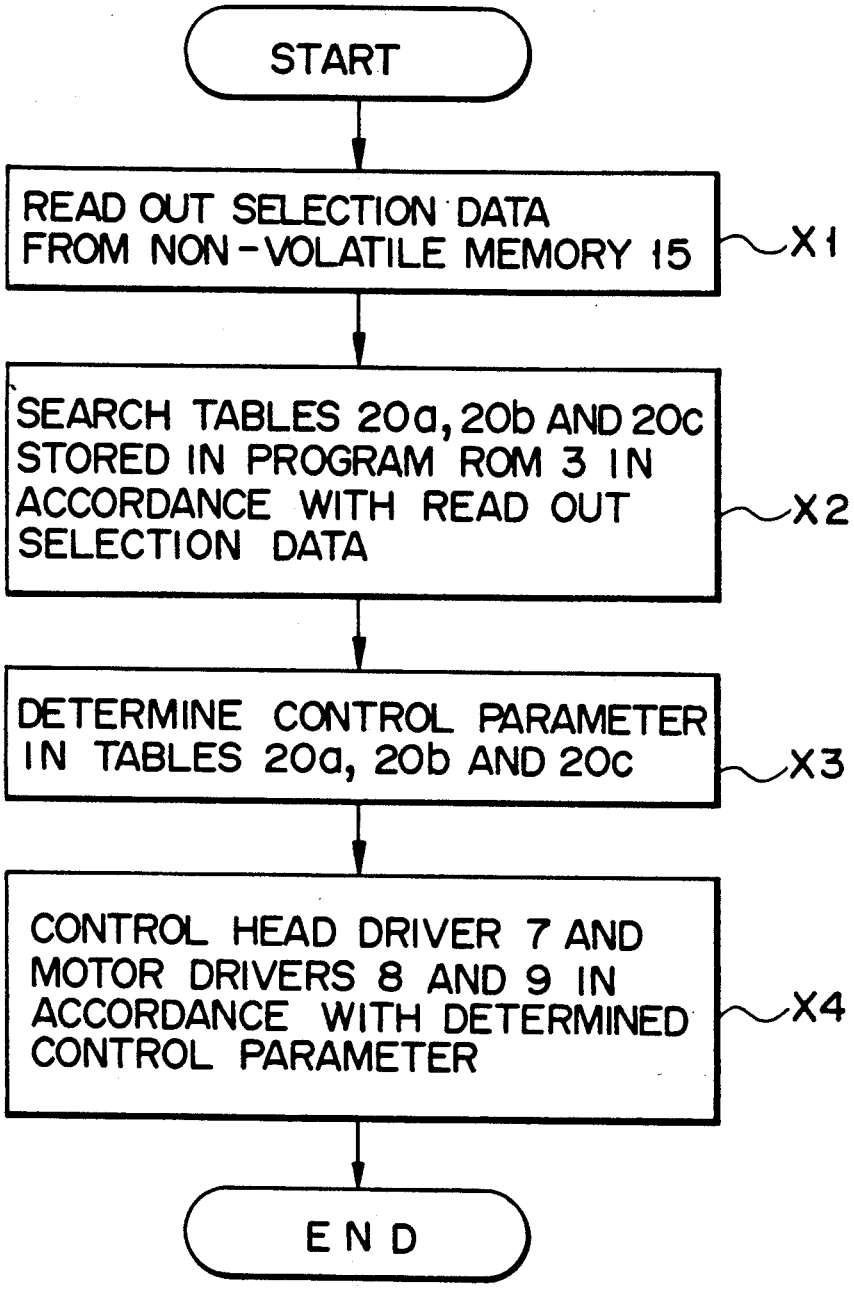
FIG. 3 is a flow chart showing an operation of the printing apparatus.

Referring to FIG. 3, the content of non-volatile memory 15 is read out prior to control of the mechanism sections in step Xl. In this case, the selection data used for selecting predetermined control parameters in accordance with the current states of the mechanism sections are stored in non-volatile memory 15 in units of mechanism sections. More specifically, the selection data for selecting a control parameter of, e.g., 100 μs for the excitation time of the print head is stored in non-volatile memory 15. Table 3a including a plurality of control parameters is prepared in program ROM 3. Table 3a includes a plurality of control parameters 20a of 100 μs, 200 μs, and 250 μs for the excitation time.

CPU 4 searches table 3a in step X2, and predetermined ones of the plurality of parameters are selected in accordance with the selection data stored in non-volatile memory 15 and read out in step X1 (step X3). In step X4, the mechanism sections are controlled in accordance with the control parameters determined in step X3. More specifically, head driver 7 is controlled on the basis of a control parameter of, e.g., 100 μs selected from the parameters of 100 μs, 200 μs, and 250 μs for the excitation time of the print head.

An operation for changing the selection data stored in non-volatile memory 15 will be described with reference to FIGS. 4A and 4B.

Figure 4A:
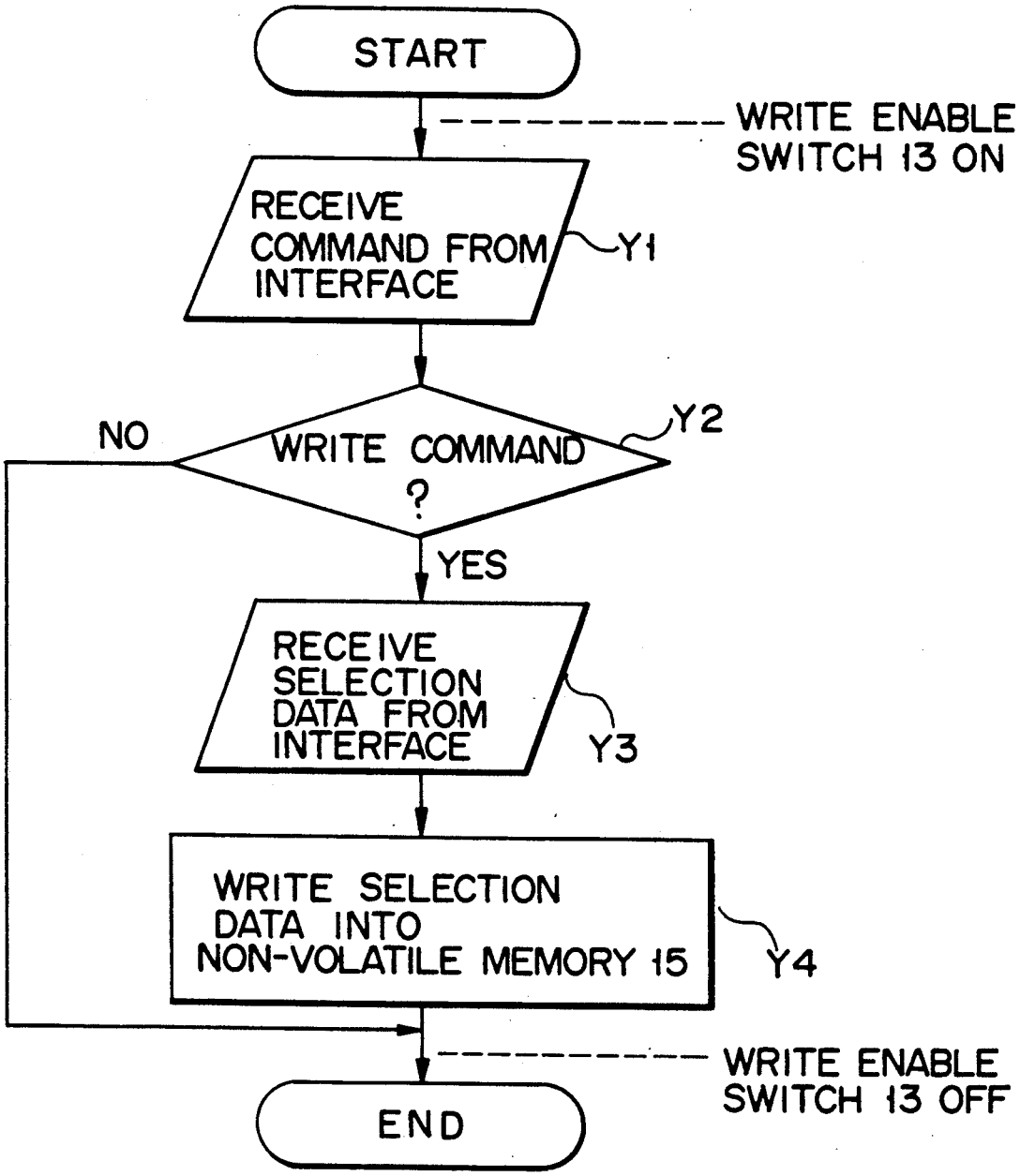
FIGS. 4A and 4B are flow charts showing an operation for changing selection data stored in a non-volatile memory.

Referring to FIG. 4A, when the control parameters must be changed by exchanging one of the mechanism sections such as, for example, print head 10, write enable switch 13 is switched to set non-volatile memory 15 in a write enable state. Personal computer 1 outputs a write command or the like to interface 2 in the same manner as in normal printing operation commands. In step Y1, CPU 4 receives the command output from interface 2. CPU 4 judges in step Y2 whether the received command is a write command. If the received command is a write command in step Y2, the selection data output from interface 2 is received by CPU 4 (step Y3). The received selection data is written into non-volatile memory 15 (step Y4). When the above operations are completed, write enable switch 13 is switched to set non-volatile memory 15 in a write inhibition state.

The selection data can also be changed by an operator upon operation at console 17.

Figure 4B:
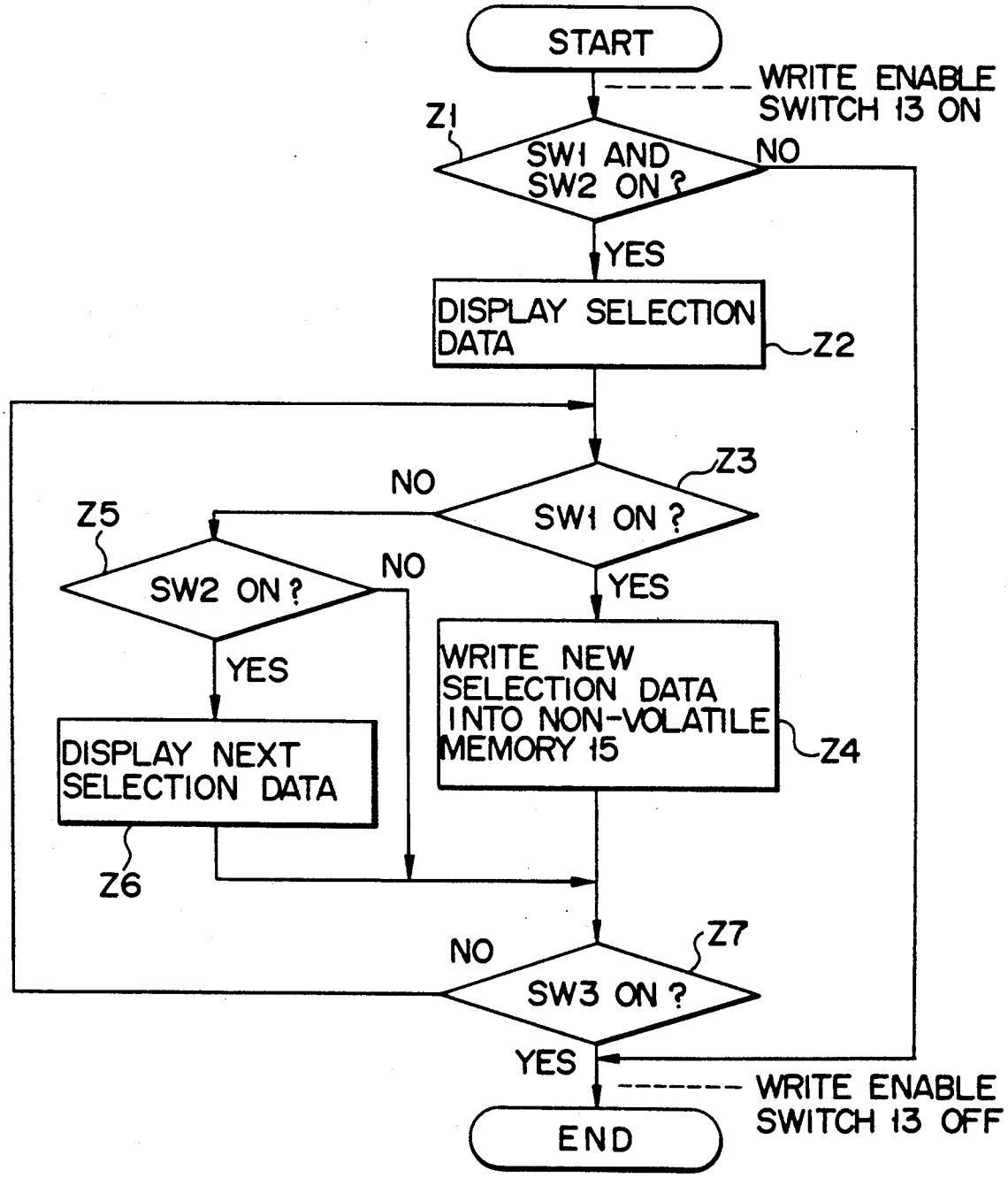

As shown in FIG. 4B, selection data is changed by using three switches (SW1, SW2, and SW3) of console 17. In this embodiment, write enable switch 13 is switched to set non-volatile memory 15 in the write enable state. CPU 4 judges in step Z1 whether the switches SW1 and SW2 are simultaneously turned on by the operator. When the switches SW1 and SW2 are simultaneously turned on in step Z1, the first selection data for the first control parameter is displayed on LCD (step Z2). The operator observes the selection data displayed on the LCD and determines whether the displayed selection data is written into non-volatile memory 15. If the displayed selection data is written into non-volatile memory 15, the operator turns on switch SW1. CPU 4 judges in step Z3 whether switch SW1 is turned on. If switch SW1 is turned on in step Z3, new selection data displayed on the LCD is written into non-volatile memory 15 (step Z4). However, if switch SW1 is off in step Z3, the process in step Z5 is performed. CPU 4 judges in step Z5 whether switch SW2 is turned on. When the operator observes the selection data displayed on the LCD and determines not to write into non-volatile memory 15, switch SW2 is turned on to display the next selection data. If it is not necessary to display next selection data, switch SW2 is turned off. When switch SW2 is turned on in step Z5, next selection data is displayed on the LCD. When changing processes in selection data are completed, the operator turns on switch SW3. CPU 4 judges in step Z7 whether switch SW3 is turned on. If switch SW3 is turned on in step Z7, the above processes are completed. Write enable switch 13 is switched to set the non-volatile memory 15 in the write inhibition state. When CPU 4 judges switch SW3 is not turned, the process in step Z3 is performed. CPU 4 judges by the condition of switch SW1 whether selection data displayed on the LCD in step Z6 is written into non-volatile memory 15. When the operator judged that selection data displayed on LCD in step Z6 is written into non-volatile memory 15, switch SW1 is turned on. In step Z3, when switch SW1 is turned on, selection data displayed on LCD now is written into non-volatile memory 15 in step Z4. Display of LCD in the case of executing the processes step Z3→step Z5→step Z6→step Z7→step Z3 is as follows. First, all selection data corresponding to the first control parameter is displayed on LCD. Next, all selection data corresponding to the second control parameter is displayed. After all selection data corresponding to all control parameters is displayed, the first selection data corresponding to first control parameter is displayed, again. As a result, display of selection data is performed cyclically.

The content of non-volatile memory 15 can be changed by the above operations. For example, when the excitation time of the print head is changed to 200 μs, the selection data for selecting the control parameter of 200 μs is stored in non-volatile memory 15. Subsequent control of the mechanism sections is performed by the control parameters read out from ROM table 3a in accordance with the changed selection data stored in non-volatile memory 15.

When changes in mechanism sections are required, unlike the conventional case, the ROM need not be replaced with a corresponding ROM, thus resulting in an economical advantage. In addition, the control program can cope with all the mechanism sections, and easy control of maintenance components can be performed.

In the future, when the memory capacity of IC (Integrated Circuit) for constituting non-volatile memory is increased, control parameters may be changed without using ROM by storing control parameters into non-volatile memory, the range of changing control parameter may be increased largely.

The present invention is not limited to this embodiment, various changes and modifications may be made within the spirit and scope of the invention.

What is claimed is:

1. A method for controlling operation of a print head, a carriage motor and a paper feed motor in a printing apparatus, the method comprising the steps of:

storing a plurality of control parameters for controlling the operation of the print head, carriage motor and paper feed motor;

non-volatilely storing selection data corresponding to the print head, carriage motor and paper feed motor for selecting predetermined control parameters of the stored control parameters;

reading out the stored control parameters in accordance with the non-volatilely stored selection data; and controlling the operation of at least one of the print head, carriage motor and paper feed motor in accordance with the readout control parameters.

2. A method according to claim 1, wherein the non-volatilely storing step includes the step of changing the stored selection data when any one of the print head, carriage motor or paper feed motor is changed.

3. A method according to claim 1, wherein at least one controlled parameter corresponding to each of the print head, carriage motor and paper feed motor is stored.

4. A method according to claim 1, wherein the selection data are stored for selecting at least one control parameter.

5. A system for controlling operation of a print head, a carriage motor and a paper feed motor in a printing apparatus, the system comprising:

control parameter memory means for storing a plurality of control parameters for controlling the operation of each of the print head, carriage motor and paper feed motor;

non-volatile memory means for non-volatilely storing selection data corresponding to each of the print head, carriage motor and paper feed motor for selecting predetermined control parameters of the control parameters stored in said control parameter memory means;

mechanism section control means for reading out selected ones of the control parameters as readout control parameters from said control parameter memory means in accordance with the selection data stored in said non-volatile memory means and for controlling the operation of at least one of the print head, carriage motor and paper feed motor in accordance with the readout control parameters; and changing means for changing the selection data stored in said non-volatile memory means.

6. A system according to claim 5, wherein at least one control parameter corresponding to each of the print head, carriage motor and paper feed motor is stored in said control parameter memory means.

7. A system according to claim 5, wherein the selection data are stored in said non-volatile memory means so as to select at least one control parameter.

8. A system according to claim 5, wherein said changing means includes:

means for allowing the changing of the selection data stored in said non-volatile memory means; and means for inhibiting the changing of the selection data.

9. A system for controlling operation of a print head, a carriage motor and a paper feed motor in a printing apparatus, the system comprising:

control parameter memory means for storing a plurality of control parameters for controlling the operation of each of the print head, carriage motor and paper feed motor;

non-volatile memory means for non-volatilely storing selection data corresponding to each of the print head, carriage motor and paper feed motor for selecting predetermined control parameters of the control parameters stored in said control parameter memory means; and mechanism section control means for reading out selected ones of the control parameters as readout parameters from said control parameter memory means in accordance with the selection data stored in said non-volatile memory means and for controlling the operation of at least one of print head, carriage motor and paper feed motor in accordance with the readout control parameters.

10. A system according to claim 9, wherein at least one control parameter corresponding to each of the print head, carriage motor and paper feed motor is stored in said control parameter memory means.

11. A system according to claim 9, wherein the selection data are stored so as to select at least one control parameter.

12. A method according to claim 1, wherein the non-volatilely storing step includes the step of changing the stored selection data in accordance with mechanism characteristics of each of the print head, carriage motor and paper feed motor.

13. A method according to claim 12, wherein the mechanism characteristics include excitation characteristics of the print head.

14. A method according to claim 12, wherein the mechanism characteristics include operation characteristics of a carriage motor.

15. A method according to claim 12, wherein the mechanism characteristics include a printing timing.

* * * * *